US010844716B2

(12) United States Patent
Jakobsen

(10) Patent No.: US 10,844,716 B2
(45) Date of Patent: Nov. 24, 2020

(54) TUNNEL WALL ELEMENT AND A METHOD OF ASSEMBLING TUNNEL WALLS COMPRISING THE TUNNEL WALL ELEMENTS

(71) Applicant: Foamrox AS, Arendal (NO)

(72) Inventor: Rolf Jakobsen, Mandal (NO)

(73) Assignee: FOAMROX AS, Arendal (NO)

( * ) Notice: Subject to any disclaimer, the term of this patent is extended or adjusted under 35 U.S.C. 154(b) by 0 days.

(21) Appl. No.: 16/090,019

(22) PCT Filed: Mar. 29, 2017

(86) PCT No.: PCT/NO2017/050077
§ 371 (c)(1),
(2) Date: Sep. 28, 2018

(87) PCT Pub. No.: WO2017/171558
PCT Pub. Date: Oct. 5, 2017

(65) Prior Publication Data

US 2019/0112925 A1 Apr. 18, 2019

(30) Foreign Application Priority Data

Mar. 30, 2016 (NO) ..... 20160515
Apr. 13, 2016 (NO) ..... 20160611

(51) Int. Cl.
*E21D 11/00* (2006.01)
*E21D 11/38* (2006.01)
*E21D 9/14* (2006.01)

(52) U.S. Cl.
CPC ..... *E21D 11/38* (2013.01); *E21D 9/14* (2013.01); *E21D 11/006* (2013.01); *E21D 11/383* (2013.01)

(58) Field of Classification Search
CPC ..... E21D 9/14; E21D 5/00
See application file for complete search history.

(56) References Cited

U.S. PATENT DOCUMENTS 3,561,223 A 2/1971 Tabor
4,007,917 A 2/1977 Brubaker
5,470,178 A * 11/1995 Weholt ..... E21D 11/38 405/150.1
8,662,796 B2 3/2014 Brown
(Continued)

FOREIGN PATENT DOCUMENTS

AU 2003248049 10/2003
CH 699099 1/2010
(Continued)

OTHER PUBLICATIONS

International Search Report and Written Opinion mailed in PCT/NO2017/050077 dated Jul. 17, 2017.
(Continued)

*Primary Examiner* — Sean D Andrish
(74) *Attorney, Agent, or Firm* — Wissing Miller LLP

(57) ABSTRACT

The present invention disclose a tunnel wall element comprising a lightweight body element coated with a fire resistant coating providing increased mechanical integrity of the tunnel wall element. The present invention is also related to a method of building road and railway tunnels with the lightweight coated tunnel element.

15 Claims, 7 Drawing Sheets

(56) References Cited

U.S. PATENT DOCUMENTS

| | | | | |
|---|---|---|---|---|
| 2003/0145534 | A1 | 8/2003 | Hojaji et al. | |
| 2004/0050100 | A1 | 3/2004 | Ungerleider et al. | |
| 2004/0123535 | A1 | 7/2004 | Hojaji et al. | |
| 2005/0019542 | A1 | 1/2005 | Hojaji et al. | |
| 2005/0057944 | A1 | 3/2005 | Pipo | |
| 2007/0138857 | A1 | 6/2007 | Van Houten | |
| 2008/0092730 | A1* | 4/2008 | Hall ..... | E04H 9/10 89/36.04 |

FOREIGN PATENT DOCUMENTS

| | | | |
|---|---|---|---|
| CN | 1458366 | | 11/2003 |
| CN | 101638990 | | 2/2010 |
| CN | 102011437 | | 4/2011 |
| CN | 203213323 | | 9/2013 |
| CN | 104329102 | | 2/2015 |
| CN | 105040934 | | 11/2015 |
| DE | 102011119976 | | 6/2013 |
| EP | 1036916 | | 9/2000 |
| EP | 1970179 | | 9/2008 |
| EP | 2177332 | | 4/2010 |
| EP | 2770130 | | 8/2014 |
| GB | 989639 | | 4/1965 |
| GB | 1318398 | * | 5/1973 |
| GB | 2076040 | * | 11/1981 |
| JP | 05133065 | * | 5/1993 |
| JP | H0642133 | | 2/1994 |
| WO | 2003097954 | | 11/2003 |
| WO | 2006050419 | | 5/2006 |
| WO | 2011110172 | | 9/2011 |
| WO | 20120177143 | | 12/2012 |

OTHER PUBLICATIONS

"Laserscanning im Tunnelbau Laserscannerblog" Oct. 20, 2011; (9 pages); htttp://www.laserscannerblog.de/2011/10 /laserscanning-im-tunnelbau-2/.

Norwegian Search Report in NO 20160611 dated Nov. 4, 2016 (4 pages).

* cited by examiner

TUNNEL WALL ELEMENT AND A METHOD OF ASSEMBLING TUNNEL WALLS COMPRISING THE TUNNEL WALL ELEMENTS

CROSS-REFERENCE TO RELATED APPLICATIONS

This application is a 371 of PCT/NO2017/050077 filed on Mar. 29, 2017, published on Oct. 5, 2017 under publication number WO 2017/171558, which claims priority benefits from Norwegian Patent Application No. 20160515 filed Mar. 30, 2016 and Norwegian Patent Application No. 20160611 filed Apr. 13, 2016, the disclosure of each is incorporated herein in their entirety by reference.

FIELD OF THE INVENTION

The present invention is related to tunnel wall elements and a method of assembling tunnel walls comprising the wall elements, and especially to tunnel wall elements manufactured out of coated foam glass, and a method of assembling coated foam glass elements into tunnel walls.

BACKGROUND OF THE INVENTION

Road and railway tunnels are usually expensive to make and security issues related to possible fires and accidents inside tunnels are well known challenges in the prior art. Conventional methods of building tunnels usually comprises drill and blast methods providing the necessary and intended tunnel profile at correct dimensions. It is also common to adapt and assemble concrete wall elements, thermal isolation, fire protections, electric wires, communication lines, traffic lights, electric lightning, water drainage etc. corresponding to the tunnel profile.

In recent years, it is common to provide images of the raw rock tunnel walls by scanning the rock faces of the drilled and blasted tunnel with a moving laser thereby identifying locations on the walls suitable for drilling bolts holding concrete wall elements being assembled afterwards. The information from computerized images captured via the laser scanning can be used to direct and position drilling equipment moving inside the tunnel while drilling. Then the mounting of the concrete elements is much easier and faster after the bolts have been attached to the rock walls.

The prior art tunnel designs includes many parts providing solutions to respective technical problems. The concrete walls provide protection against pieces of rock that may loosen from the tunnel rock faces and fall down onto the traffic lanes or railway tracks, for example. Protection against ice formation and frost control is necessary since water freezing to ice increases in volume as known in prior art. The forces induced on the surroundings from freezing water, for example water left in cracks in the rock face of the tunnel, can be large in magnitude and can result in stones falling off the rock wall of the tunnel. Further, frost may make for example the roads in the tunnel very slippery. When concrete wall elements are assembled, it may be left voids between the concrete element surfaces facing the rock surface of the tunnel. Water may assemble in these voids, and if the ice formation protection is insufficient, the water in the voids may cause structural damage to the concrete walls of the tunnel.

Fire is of course a challenge and the concrete walls may protect the tunnel from collapsing due to heat induced structural changes in the rock walls of the tunnel (due to thermal expansion for example). Therefore, fire protection is an essential safety issue of road and railway tunnels.

US 200700138857 A1 disclose a vehicle with a milling arrangement on the top side of the machine. The milling arrangement includes a milling device for grinding an upper tunnel wall surface like tunnel ceilings of traffic tunnels. Such a vehicle with the milling arrangement according to the invention is suitable for treating tunnel walls such that a desired surface roughness and the removal of carbon black results. This assures that a lining, which is applied to the tunnel ceiling and wall surface, is sufficiently attached to the surfaces.

U.S. Pat. No. 8,662,796 B2 disclose a method for lining tunnel walls or ceilings with protective nets or the like, web-shaped protective net material is unwound from a reel and is fastened to the tunnel walls or ceiling by tie bolts. The reel is rotatable arranged. The rotation of the reel about a shaft is controlled in order to unwind the protective net material, the shaft being mechanically moved in steps along the tunnel walls or ceiling together with the reel. The stretching and mechanically fastening of the protective net is preferably executed when unwound in each step.

U.S. Pat. No. 3,561,223 A disclose a tunnel making machine adapted not only to tunnel through the earth, but also to concurrently form a concrete wall in the tunnel. Forms for the concrete wall are erected by the machine at the head end thereof and are removed by the machine at the tail end thereof. The forms remain in place only long enough for the concrete to harden and are constantly reused, those from the tail end being transferred to the head end in a continuous process of form reuse. Removal of the forms at the tail end of the machine leaves the tunnel complete rearward of the machine with a smooth concrete wall or bore.

CN 101638990 B disclose a fireproof thermal-insulation layer of a tunnel and a construction method thereof. The fireproof thermal-insulation layer comprises a polyurethane thermal-insulation layer connected with two linings of the tunnel and an external fireproof layer, wherein the fireproof layer is made by pressing one or two kinds of medium-alkali glass fiber cloth and non-woven fabric, which are taken as basal materials, and waterproof and fireproof components.

US 2004050100 A1 disclose a composite panel for the building industry avoiding the use of plastic foam materials as known in SIP's (Structural Insulating Panel) and EIFS (Exterior Insulating Finishing System) panels. Plastic and hydrocarbon foam based materials can be an environmental threat as known in the prior art. The prosed improved alternative comprises a method of mixing together glass and 0.1 to 20.0% by weight of at least one non-sulfur based foaming agent and heating the mixture sufficient to foam the mixture. During or after the a cooling step at least one side of the panel is bonded with material thereby forming the composite panel.

GB 989639 A disclose a method and apparatus for continuously coating panels. Panels are coated with a surface covering so as to render at least one surface of the panel to be electrically insulating and/or decorative. Two rigid opposed panels, for example made out of asbestos cement, plywood, hard fiber, foam plastic, etc. are provided with filler impregnated synthetic resin layers on their surfaces and are assembled with a core layer consisting of foam panels, glass foam panels, honeycomb panels of paper or the like. The base panels are conveyed between conveyers of for example an endless belt type and the panels are for example joined by heating. The finished coated panels are then laminated panels comprising respective different material layers.

The cost of making safe road and railway tunnels are high and therefore there is a need of improved tunnel designs providing cheaper tunnels that preferably are simpler to build, faster to build and which requires less maintenance and improved lifetime. Especially, it would be an advantage to use a lightweight tunnel wall element providing the necessary heat, cold, and water protection properties in on simple wall element design that is lightweight facilitating assembly of a complete tunnel wall.

It is further an advantage if a wall element can be adapted to a specific tunnel wall profile wherein the respective wall element surface areas are as large as possible covering as large as possible areas of the raw rock wall of the tunnel when assembled.

OBJECT OF THE INVENTION

It is a further object of the present invention to provide an alternative to the prior art.

In particular, it may be seen as an object of the present invention to provide a lightweight tunnel wall element facilitating assembling water, heat and fire resistant tunnel walls comprising the lightweight tunnel wall element.

SUMMARY OF THE INVENTION

Thus, the above described object and several other objects are intended to be obtained in a first aspect of the invention by providing a tunnel wall element constituted by a lightweight element having thermal insulating properties coated with a fireproof coating increasing the mechanical integrity of the lightweight element.

An aspect of the present invention is to provide a tunnel wall element constituted by a tunnel wall element constituted by lightweight coated elements, wherein a kernel of the lightweight element is made of foam glass, and wherein the coating is polyurea providing mechanical integrity of the foam glass kernel, wherein the size of respective tunnel wall elements with respect to height and/or width and thickness and contour shapes of specific tunnel wall elements are adapted to specific local rock wall geometries and local conditions of specific locations on the rock wall of a road or railway tunnel the respective tunnel wall elements are to be applied, wherein the adaptation of the respective tunnel wall elements to local conditions is done by measuring the rock wall geometries and conditions before a specific tunnel wall element related to a specific tunnel wall location is pre-manufactured, wherein the respective tunnel wall elements are labelled with an identification label identifying the specific locations the respective tunnel wall elements are to be applied in the tunnel when assembling the tunnel wall elements.

Further, the tunnel wall element may have an angle of an end surface of a first tunnel wall element relative to a front or backside surface of the first tunnel wall element, which is adapted to a corresponding angle of an end surface of a second tunnel wall element being located adjacent to the end surface of the first tunnel wall element when a part of the tunnel wall is assembled with the first and second tunnel wall element adjacent to each other.

Further, the tunnel wall element may have a contour shape of a first tunnel wall element that is adapted to a contour shape of a second tunnel wall element being located adjacent to the first wall element when a part of the tunnel wall is assembled with the first and second tunnel wall element.

Further, the adaptation of a specific tunnel wall element is according to a standardized predefined set of specifications for a specific tunnel.

Further, the adaptation of thickness of the tunnel wall element is according to an identified local temperature condition on the local location the tunnel wall element is to be applied.

Further, wherein a periphery of a tunnel wall element may be strengthened with an additional profile of composite material that can partly or completely surround the tunnel wall element periphery.

Further, the added strengthening profile may be attached to the foam glass kernel of the tunnel wall element before polyurea is applied, wherein the shape and angles of end surfaces of the added strengthening profile is adapted to the tunnel wall element before polyurea is applied.

Further, the added strengthening profile may be attached to the foam glass kernel of the tunnel wall element after the polyurea is applied, wherein the shape and angles of end surfaces of the added strengthening profile is adapted to the tunnel wall element after polyurea is applied.

A road or railway tunnel comprising a plurality of lightweight tunnel wall elements according to the present invention may provide that respective tunnel wall elements are lining a rock wall of the tunnel, wherein a concrete layer is applied between the rock wall and the respective tunnel wall elements.

The road or railway tunnel may further comprise a H shaped beam of composite material that is arranged in a bottom section of a tunnel wall, and wherein tunnel wall elements are positioned and secured in the upper opening of the H shaped beam, The road or railway tunnel may further comprise at least one light source that is arranged behind a releasable cover in the lower section of the H shaped beam, wherein optical fibers are arranged on the back side of respective tunnel wall elements, wherein a first end of respective optical fibers are operatively in contact with the at least one light source, wherein a second end opposite the first end of the respective optical fibers are guided through respective tunnel wall elements, thereby the respective optical fibers transfer light from the at least one light source into the interior of the tunnel.

The road or railway tunnel may further comprise hollow bolts arranged in between joining end surfaces of adjacent tunnel wall elements, wherein the hollow bolts may support traffic lights or traffic signs on sidewalls of the tunnel, while bolts arranged in the ceiling of the tunnel may support cable bridges.

The road and railway tunnel my further comprise hollow bolts arranged to guide electric cables, optical fibers, communication lines, and similar objects to/from the backside of the tunnel wall elements to/from the front side of the tunnel wall elements, A method of assembling a tunnel wall comprising lightweight tunnel wall elements, may comprise steps of, obtaining a computerized image of a drilled and blasted tunnel profile of the tunnel by scanning rock faces of the tunnel with a moving laser scanner moving through the tunnel in the longitudinal direction of the tunnel, using the computerized image to tailor the width and/or height of specific tunnel wall elements to specific locations of the rock wall before the specific tunnel wall elements are manufactured.

The method may further comprise a step wherein the computer image of the tunnel walls are used to plan locations of indents in the concrete applied on the back of the tunnel wall elements, thereby forming water drainage channels.

The method may further comprise a step wherein the computer image of the tunnel walls are used to identify possible maximized surfaces of respective tunnel wall elements thereby reducing the number of tunnel wall elements needed for lining the tunnel.

Respective aspects of the present invention may each be combined with any of the other aspects. These and other aspects of the invention will be apparent from and elucidated with reference to the embodiments described hereinafter.

DESCRIPTION OF THE FIGURES

The tunnel wall element and the method of building tunnel walls with the tunnel wall elements according to the present invention will now be described in more detail with reference to the accompanying figures. The accompanying figures illustrates an example of embodiment of the present invention and is not to be construed as being limiting to other possible embodiments falling within the scope of the attached claim set.

DETAILED DESCRIPTION OF AN EMBODIMENT

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. The mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

Figure 1A:
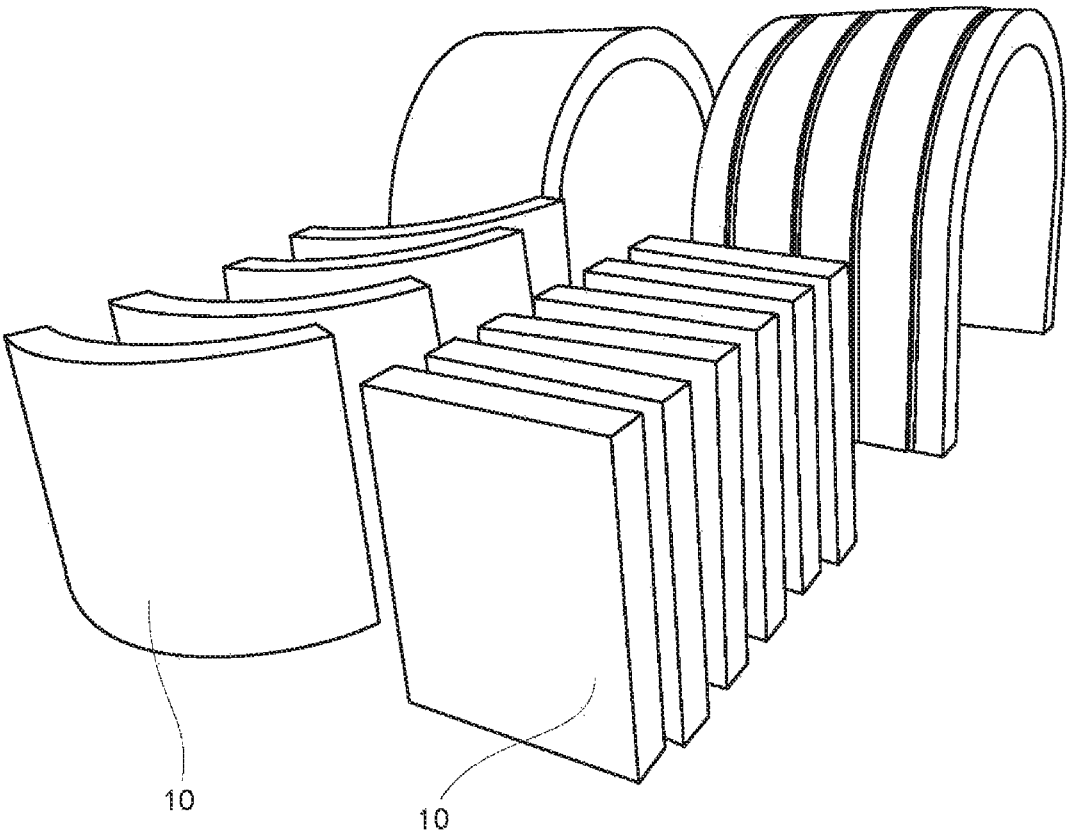
FIG. 1A illustrates an example of tunnel wall elements according to the present invention.
Figure 1B:
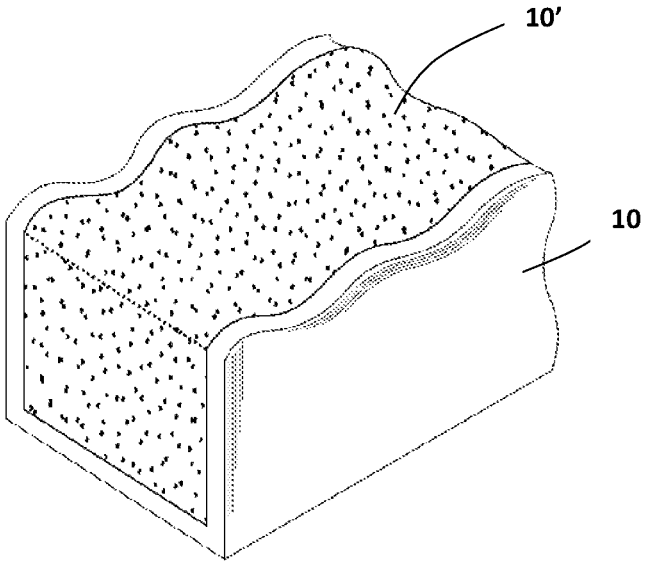
FIG. 1B illustrates a cross sectional view of the tunnel wall element in FIG. 1A.
Figure 2:
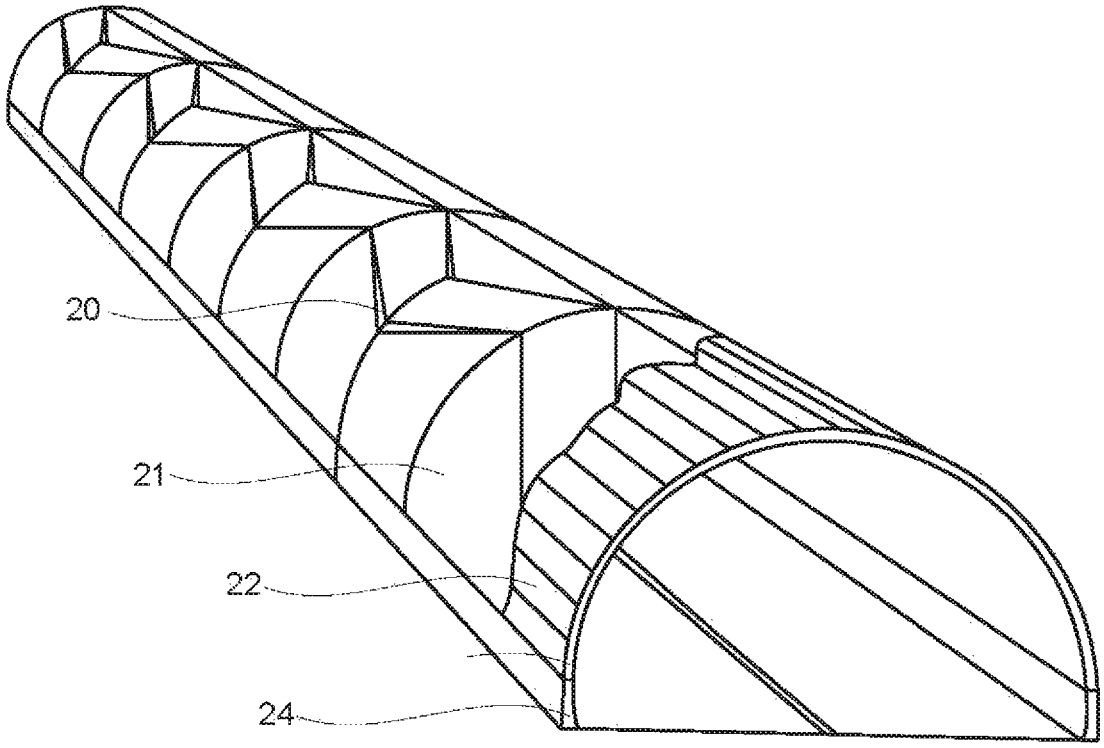
FIG. 2 illustrates an example of a tunnel design according to the present invention.

A first aspect of the present invention is to combine water, fire and frost prevention features in a lightweight wall element body. FIG. 1A illustrates examples of tunnel wall elements 10 according to the present invention comprising a kernel of foam glass 10*a* coated with polyurea 10*b*, refer FIG. 1B. The foam glass is lightweight, and the coating increases the mechanical integrity of the foam glass kernel. FIG. 2 illustrates an example of a tunnel design according to the present invention using respective straight and curved tunnel wall elements 22 like the examples of elements 10 illustrated in FIG. 1A. The respective tunnel wall elements 22 is stacked on top of each other upwards and sideways covering the tunnel surface. Any voids between the stacked tunnel wall elements 22 and the rock wall of the drilled and blasted tunnel is filled with concrete 21. Indents 20 may be arranged spaced regularly along the tunnel length in the concrete facing towards the rock walls of the tunnel providing water channels leading water leaking through the rocks away from the tunnel. A water collecting channel is arranged at the bottom sides of the tunnel. The wall elements constituting the complete tunnel wall may be ended with a concrete end section 24.

The polyurea coating of the respective foam glass elements provides water, fire and ice formation prevention. The foam glass in itself is also fireproof and the foam glass structure provides excellent thermal insulating properties. In addition, the polyurea coating transforms the foam glass kernel of a tunnel wall element 22 into an element with exceptional mechanical strength with respect to withstanding possible damage when being transported, during assembly etc., and other external forces. For example, the rupture strength of a typical tunnel wall element 22 according to the present invention is identified to be better than what can be found in any comparable steel enforced concrete element.

The tunnel wall element according to the present invention utilize the beneficial properties of the foam glass itself when used in a tunnel wall element as discussed above. The present invention utilize also a further aspect of foam glass as a core element of a tunnel wall element in that the foam glass is very easy to saw through. In this respect, it is possible to adapt an outer shape of a wall element by first sawing a foam glass block to a specific shape including adapting both curvature of edges of a foam glass block as well as thickness and angles of end surfaces of the foam glass block before applying the polyurea coating. This in contrast to the known concrete wall elements that would need prefabricated molds to be manufactured with specific adaptions to specific wall conditions of a specific tunnel. According to an aspect of the present invention, all the beneficial properties of wall elements according to the present invention may be utilized to provide tailor-made manufacturing of wall elements of specific tunnels in a cost effective manner either in a fabric, or directly online at the tunnel building site.

The spraying of concrete 21 depicted in FIG. 2 "holds" the rock of the tunnel stable. In prior art, when concrete wall elements are assembled, the tunnel profile must be adapted to the prefabricated concrete wall elements. An aspect of the present invention is that the concrete layer 21 makes it possible to adapt pre-fabricated tunnel wall elements 22 to the tunnel profile, i.e. opposite of what is possible in the prior art. The tunnel surface and profile may be made with less tolerance than in prior art since the concrete layer 21 bridges all possible uneven surfaces of the rock remaining after the drilling and blasting of the tunnel profile. Further, the concrete layer 21 "holds" the rock of the tunnel in place.

It is also within the scope of the present invention of arranging additional profiles made out of composite materials around the periphery of respective tunnel wall elements according to the present invention. The additional profiles may not surround the periphery completely, but can do so partly for example like an U shaped profile, or an L shaped profile. Thereby the mechanical integrity will be increased, and the shape of the extra profile can be adapted to specific demands of strengthening a tunnel wall element. Added profiles may be integrated with the foam glass kernel before polyurea is applied, or afterwards onto the polyurea coated surfaces of a tunnel wall element.

A laser scan of the surface as known in prior art may provide a computerized image of the tunnel surface. This information may be used to assess if a specific tunnel dimension can be achieved when assembling wall elements. Further, the amount of concrete 21 to be used when filling the void between the rock surface and respective tunnel wall elements 22 according to the present invention can be calculated together with the distribution of the concrete 21 over the rock surface of the tunnel. When calculating the distribution of the volume of the concrete layer 21, the calculation takes into consideration that the surface of the concrete layer 21 facing towards the rock of the tunnel wall is uneven, and that the other opposite side surface of the concrete 21 is facing towards the back of the tunnel wall element 22 is smooth.

In addition, the computer image of the rock walls of the tunnel may be used to tailor the size like height and/or width and thickness in of respective tunnel wall elements 22 before they are pre-fabricated. Dependent on the curvature of a bend for example, in the length direction of the tunnel, an optimized number of elements may be provided with correct angles between adjacent end surfaces of adjacent wall elements 22. A ceiling of the tunnel may also require adjusting angles of end surfaces of adjacent tunnel wall elements 22 being applied on the ceiling. Also, tailoring different sizes of respective elements 22 with respect to rock wall geometries and local conditions like for example possible exposure to ice formation, makes it possible to manufacture tunnel wall elements 22 with maximized surface area which will reduce the work load and time of mounting respective tunnel wall elements 22 to the tunnel walls [an] and ceilings. The geometric shape of a wall element 22 may also be adapted to specific geometrical conditions of a specific location in the tunnel.

For example, two tunnels that may be meeting inside a tunnel (side roads entering a main tunnel for example) may require special shapes and geometry of the tunnel wall elements 22. Since the kernel of the tunnel wall elements are made of foam glass, cutting and forming shapes are extremely easy. The polyurea coating will be applied after the tailoring of the foam glass element shapes are done.

Its is further within the scope of the present invention that tunnel wall elements 22 according to the present invention are according to a standardized predefined set of specifications for a specific tunnel. This implies that wall elements may be manufactured as a set of equal sized wall elements identified to be suitable for a specific tunnel profile.

According to a method according to the present invention, use of laser scanning can provide a computerized image of the rock walls of the tunnel that may be used to calculate the necessary amount of concrete 21 to be filled in voids between the rock walls and the tunnel wall elements 22. In addition, the distribution of the concrete layer 21 over the rock walls of the tunnel can be calculated as discussed above. This information can then be used to control an apparatus or robot that positions a specific tunnel wall element up against a specific location of the rock wall of the tunnel while the comet amount of concrete 21 for this specific location is applied on the backside of the specific tunnel wall element 22. When respective wall elements 22 are tailored to specific locations on the tunnel wall, a bar-code-label or other identifications like RFID (Radio Frequency Identification) markers may be attached to the tunnel wall element 22 providing information about the location along the tunnel wall a robot may attach the specific tunnel wall element 22. The robot may then scan the bar-code-labels or read the RFID marker before attaching the tunnel wall elements and applying the specific volume of concrete for the specific location according to the label or marker.

The computer image of the tunnel walls may also be used to plan locations of indents 20 in the concrete 21 applied on the back of the tunnel wall elements 22, thereby forming water drainage channels. When concrete 21 is applied in voids between the tunnel wall elements 22 and the rock wall of the tunnel, a mold or formwork defining the water drainage channel may be attached when the tunnel wall element 22 for this specific location is mounted.

Figure 3:
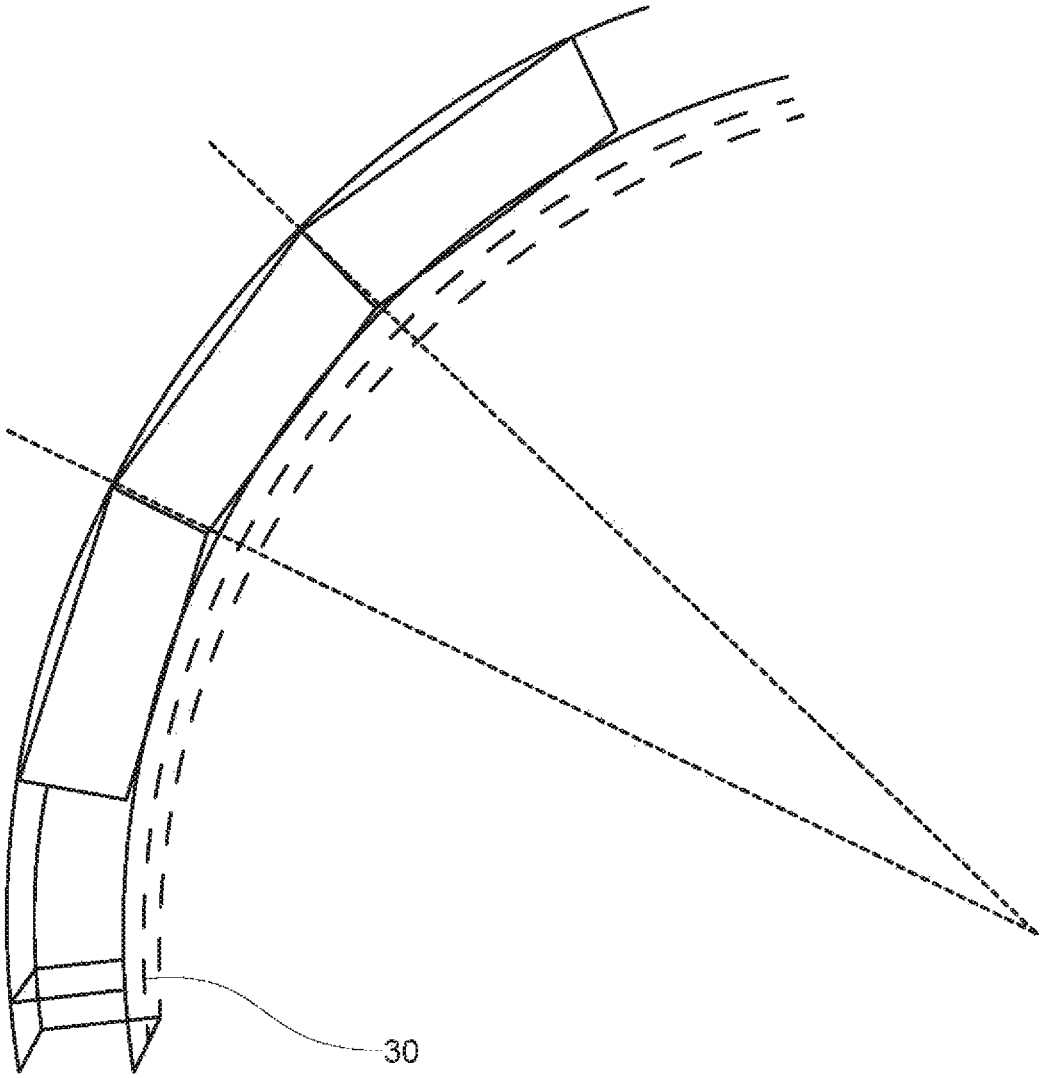
FIG. 3 illustrates an example of a tunnel section according to the present invention.
Figure 4:
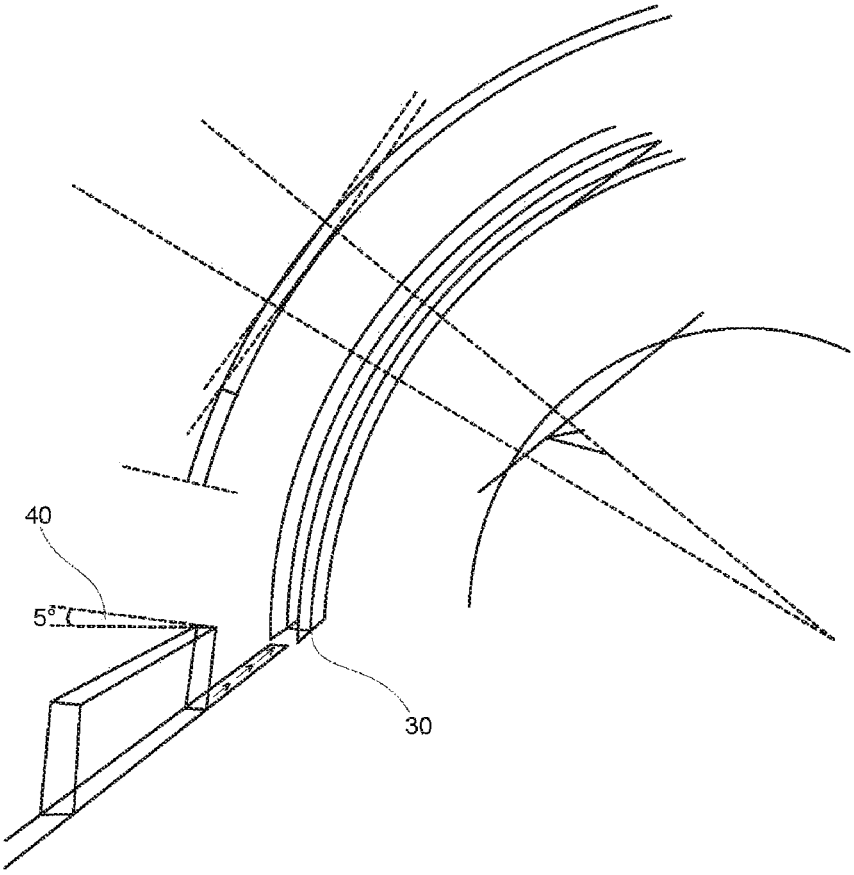
FIG. 4 illustrates another example of a tunnel section according to the present invention.

There may be different environmental challenges due to different environmental properties of the location of a tunnel. For example, up north in Norway thermal insulation need to be higher than for a tunnel south in Italy. This requirement can easily be accounted for in examples of embodiments of the present invention in that thickness of the foam glass elements are increased if better ice formation protection is necessary. Due to the lightweight property of foam glass, the weight increase of the foam glass elements, and hence handling properties of wall elements 22, is not an issue, FIG. 3 (and FIG. 4) illustrates an example of using a H shaped beam 30 made out of a composite material in the bottom of a tunnel wall. A wall element 22 is inserted into an upper part of the H shaped beam 30, A curved tunnel profile can be lined with tunnel wall elements 22 according to the present invention by adjusting the angle between adjacent tunnel wall elements 22 being stacked on top of each other. The angle may be identified by drawing lines from a center point of the tunnel profile passing through adjacent faces of the respective tunnel wall elements. FIG. 4 illustrates an example wherein the angle 40 is 5°.

Figure 5:
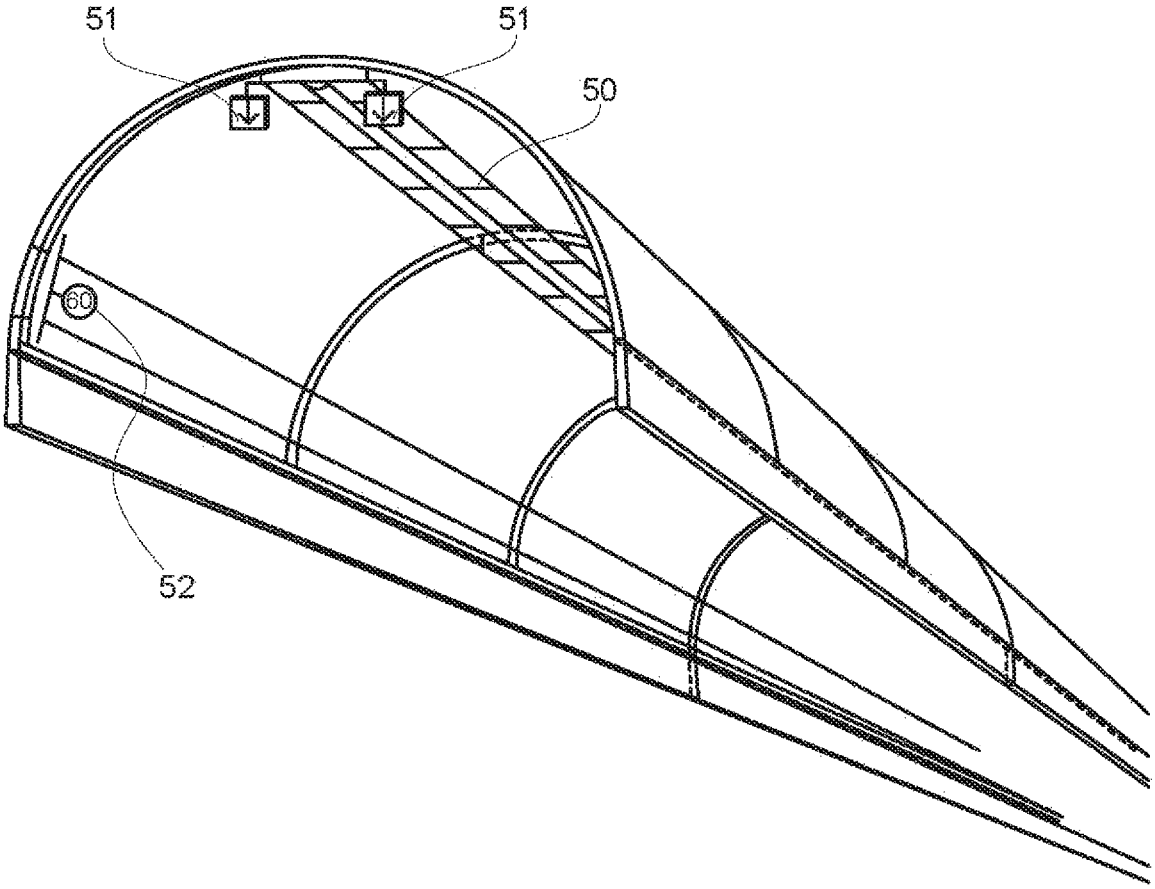
FIG. 5 illustrate an example of a tunnel design according to the present invention.

Other tunnel elements like a cable bridge 50 can be attached to the roof of the tunnel as well as traffic lights 51 and traffic signs 52 as illustrated in FIG. 5.

Figure 6:
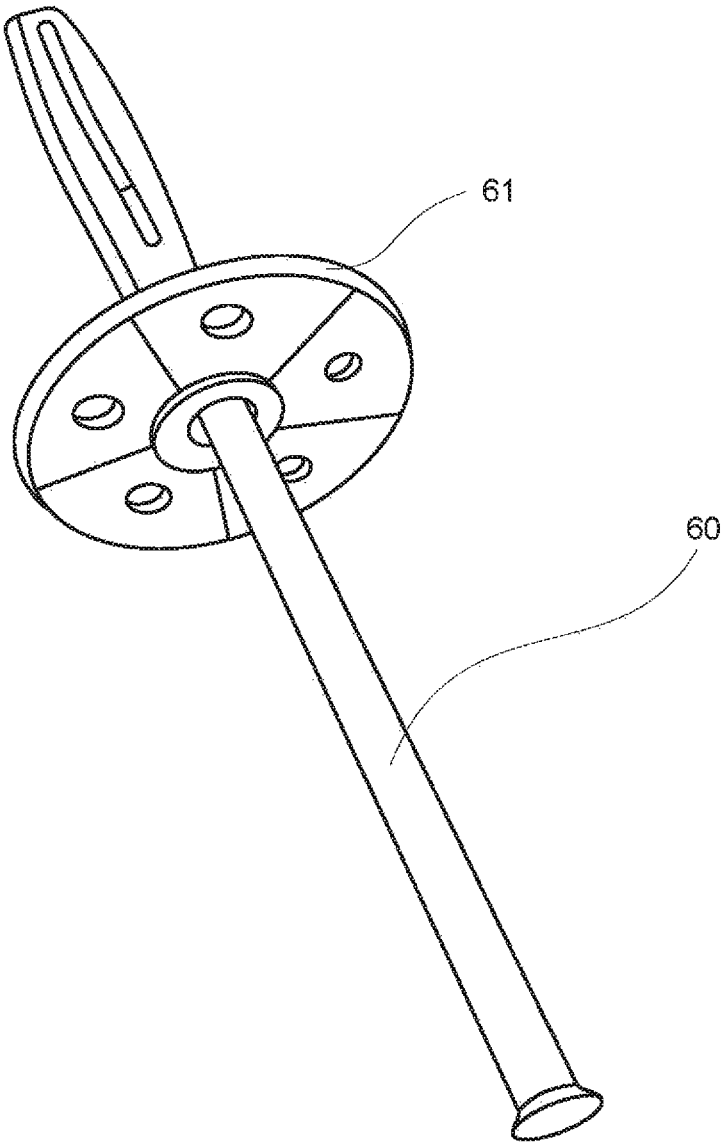
FIG. 6 illustrates an example of a fastening element according to the present invention.

FIG. 6 illustrate a bolt 60 made out of composite materials that can be used to hold tunnel wall elements together during the process of mounting the respective tunnel wall elements while for example concrete 21 is applied on the back side of the tunnel wall elements 22. In the figure, only one circular plate 61 is illustrated, but when two circular plates 61 are used, the plates 61 of the bolt 60 can hold two adjacent wall elements 22 together when concrete 21 for example is applied. A first circular plate 61 is arranged to be positioned on the front side of the two adjacent tunnel wall elements 22 while the second circular plate 61 is arranged on the back side of the two adjacent tunnel wall elements 22. The bolt elements 60 can be arranged hollow and may further be used to attach the cable bridges 50 and other tunnel elements to the tunnel walls or ceilings of the tunnel illustrated in FIG. 5. Further, the hollow feature of the bolts 60 may be used to arrange for example electric cables to/from the backside of the tunnel wall elements to/from the front side of the tunnel wall elements.

When the bolt 60 in FIG. 6 is used, there will be a narrow opening between adjacent tunnel wall elements 22. However, such openings can be closed by applying a sealing element providing thermal insulation and fire protection of the respective narrow openings.

Figure 7:
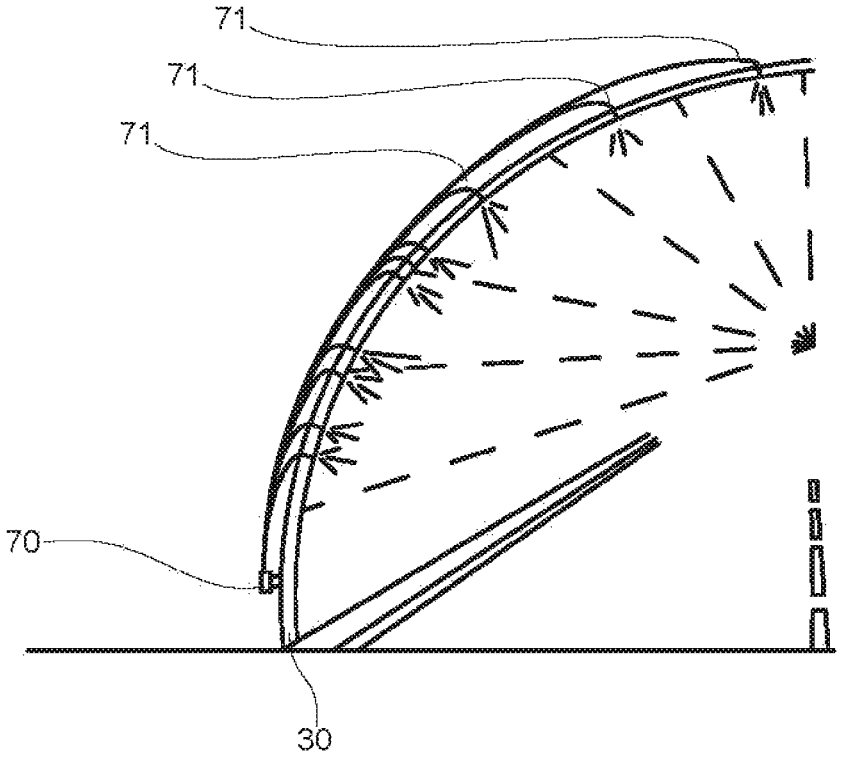
FIG. 7 illustrates an example of a tunnel lightning arrangement according to the present invention.

FIG. 7 illustrates an example of a lightning arrangement according to the present invention. A light source is for example arranged at a bottom section of the wall elements. For example, the H shaped beam 30 illustrated in FIG. 3

(and FIG. 4) can be used to house the light source 70 behind a releasable cover. There might also be a plurality of light sources arranged this way along the length of the tunnel. The light source(s) is in communication with a plurality of optical fibers 71 extending upwards and sideways from the light source 70. The end of the respective optical fibers are arranged through the tunnel wall elements thereby emitting light into the interior of the tunnel. In examples of embodiments of the present invention, the optical fibers 71 may be integrated into the body of the foam glass elements if the tunnel wall elements according to the present invention. In this manner will the respective optical fibers 71 also be protected against water, fire and ice formation.

The present invention disclose a light weight tunnel wall element comprising a kernel of foam glass covered with polyurea. The shape of the foam glass kernel can be easily and cost effectively be adapted to tunnel wall requirements before the polyurea is applied.

Further, there is no need for example with reinforcing elements like iron rods inside the tunnel wall elements according to the present invention contrary to what is necessary with concrete tunnel wall elements in prior art. Therefore, corrosion problems are avoided as well as possible problems with electric grounding.

The light weight property of the wall tunnel elements according to the present invention simplifies the handling and can be handled by smaller and more effective machinery compared to handling heavy concrete wall elements of the prior art, which reduces the $CO_2$ imprint on the environment.

The insulating property of the foam glass results in fewer steps when installing the wall elements compared to prior art solutions, which requires a separate installation of a layer providing insulation.

The fireproof property of the foam glass simplifies also the installation since the fireproof property of foam glass is significantly better than those found in concrete wall elements. It is known that concrete wall elements may crack when exposed to heat from car fires inside road tunnels for example. The heat insulating material usually used in prior art tunnels is known to be set on fire under certain conditions.

The inherent fireproof property of foam glass improves the fire security of road and railway tunnels considerable.

Further, respective properties of the foam glass kernel of a tunnel wall element according to the present invention makes it possible to provide tailor-made tunnel wall elements providing respective optimization of surface area of tunnel wall elements, optimization of wall element thickness, and optimization of contour shapes of respective tunnel wall elements. As part of a tunnel wall optimization, respective tunnel wall elements according to the present invention may be manufactured in different sizes and contour shapes for a same tunnel.

The invention claimed is:

1. A tunnel wall element for lining an exposed surface of a rock wall forming a tunnel, the tunnel wall element comprising:

a shaped member configured to be mounted directly to the exposed surface of the rock wall, the shaped member having an inner kernel portion made of lightweight foam glass and an outer strengthening portion coating covering the kernel portion and made of polyurea, wherein a height, width, thickness and contour of the shaped member is adapted to fit with a predefined rock wall geometry within the tunnel and adapted to environmental conditions associated with the predefined rock wall geometry.

2. The tunnel wall element according to claim 1, wherein an end surface of a front or rear surface of the shaped member is angled to correspond an end surface of an adjacent tunnel wall element when the shaped member is mounted to the predefined rock wall geometry.

3. The tunnel wall element according to claim 1, wherein the contour of the shaped member is adapted to a contour of an adjacent tunnel wall element when the shaped member is mounted to the predefined rock wall geometry.

4. The tunnel wall element according to claim 1, wherein the height, width, thickness and contour of the shaped member is according to a predefined set of specifications for a specific tunnel.

5. The tunnel wall element according to claim 1, wherein the thickness of the shaped member is based upon temperature conditions associated with the predefined rock wall geometry.

6. The tunnel wall element according to claim 1, wherein the shaped member further comprises a profile member made of a composite material attached to the shaped member so as to at least partially surround a periphery of the shaped member.

7. The tunnel wall element according to claim 6, wherein the profile member is attached to the kernel portion of the shaped member before the strengthening portion is coated on the kernel portion.

8. The tunnel wall element according to claim 6, wherein the profile member is attached to the kernel portion of the shaped member after the strengthening portion is coated on the kernel portion.

9. A road or railway tunnel comprising:

a plurality of tunnel wall elements mounted to an exposed surface of a rock wall to form a lining over the rock wall, each tunnel wall element comprising:

a shaped member configured to be mounted directly to the exposed surface of the rock wall, the shaped member having an inner kernel portion made of lightweight foam glass and an outer strengthening portion coating covering the kernel portion and made of polyurea, wherein a height, width, thickness and contour of the shaped member is adapted to fit with a predefined rock wall geometry within the tunnel and adapted to environmental conditions associated with the predefined rock wall geometry.

10. The road or railway tunnel according to claim 9, wherein one or more shaped beams of composite material are positioned adjacent the rock wall of the tunnel, wherein the one or more shaped beams are capable of receiving and supporting one or more of the plurality of shaped members.

11. The road or railway tunnel according to claim 10, wherein the one or more shaped beams are H-shaped beams.

12. The road or railway tunnel according to claim 9, wherein one or more optical fibers extend along the one or more shaped beams between the plurality of shaped members and the rock wall, wherein a first end of the one or more optical fibers is operatively coupled to at least one light source and a second end of the one or more optical fibers extends through at least one of the plurality of shaped members so that light from the at least one light source can illuminate an interior of the tunnel.

13. The road or railway tunnel according to claim 12, wherein the at least one light source is arranged behind a releasable cover in a section of the one or more shaped beams.

14. A method for lining an exposed surface of a rock wall of a tunnel with a plurality of shaped members, the method comprising:

obtaining a computerized image of the exposed surface of the rock wall by scanning the exposed surface of the rock wall with a laser scanner moving through the tunnel from one end of the tunnel to another end of the tunnel;

shaping each of the plurality of shaped members using the computerized image, wherein each shaped member is configured to be mounted directly to a designated section of the exposed surface of the rock wall, wherein each shaped member has an inner kernel portion made of lightweight foam glass and an outer strengthening portion coating covering the kernel portion and made of polyurea, and wherein a height, width, thickness and contour of each shaped member is derived from the computerized image; and mounting each of the plurality of tunnel wall elements to the exposed surface of the rock wall in its respective designated section to form the lining over the rock wall.

15. The method according to claim 14, wherein the computerized image is used to designate locations on a rear surface of each of the plurality of shaped members where concrete is to be applied to form a water drainage channel behind the shaped member, and applying concrete to each of the plurality of shaped members prior to mounting each of the plurality of shaped members to the rock wall.

* * * * *